US005369555A

United States Patent [19]

McKain et al.

[11] Patent Number: 5,369,555

[45] Date of Patent: Nov. 29, 1994

[54] LIGHT EMITTING SCREWDRIVER

[76] Inventors: Paul C. McKain, 3300 NW. 97th Ave., Sunrise, Fla. 33351; Mark Fritze, 558 Lakeside Cir., Sunrise, Fla. 33326

[21] Appl. No.: 174,257

[22] Filed: Dec. 28, 1993

[51] Int. Cl.[5] ..... B25B 23/18

[52] U.S. Cl. ..... 362/120; 362/32; 362/183; 7/165

[58] Field of Search ..... 362/32, 109, 118, 119, 362/120, 253, 234, 183; 7/165; 81/451

[56] References Cited

U.S. PATENT DOCUMENTS 4,283,757 8/1981 Nalbandian et al. ..... 362/120
4,768,137 8/1988 Hwaw et al. ..... 362/120
5,051,876 9/1991 Norman ..... 362/120
5,211,468 5/1993 Jeng ..... 362/120

*Primary Examiner*—Stephen F. Husar
*Attorney, Agent, or Firm*—Robert M. Downey

[57] ABSTRACT

A screwdriver includes a solid core handle formed of a light conductive material, a light source and a power source encapsulated within the solid core handle and a shaft attached to and extending outwardly from a first end of the handle and terminating at a free distal end. Operation of a switch on the handle to an on position serves to complete a circuit, activating the light bulb and, thereby directing light through an upper portion and out from the first end of the handle towards the distal end of the shaft.

14 Claims, 1 Drawing Sheet

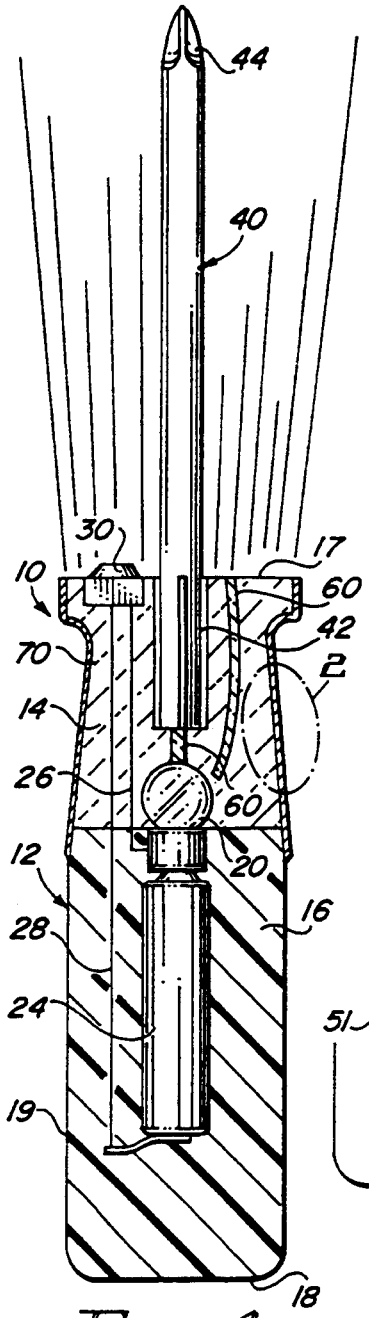
FIG. 1
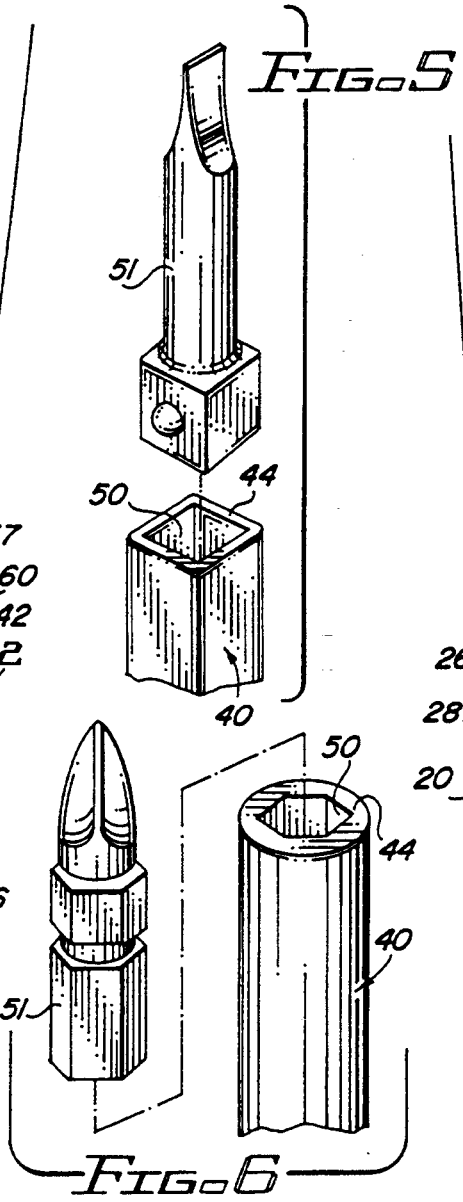
FIG. 5
FIG. 6
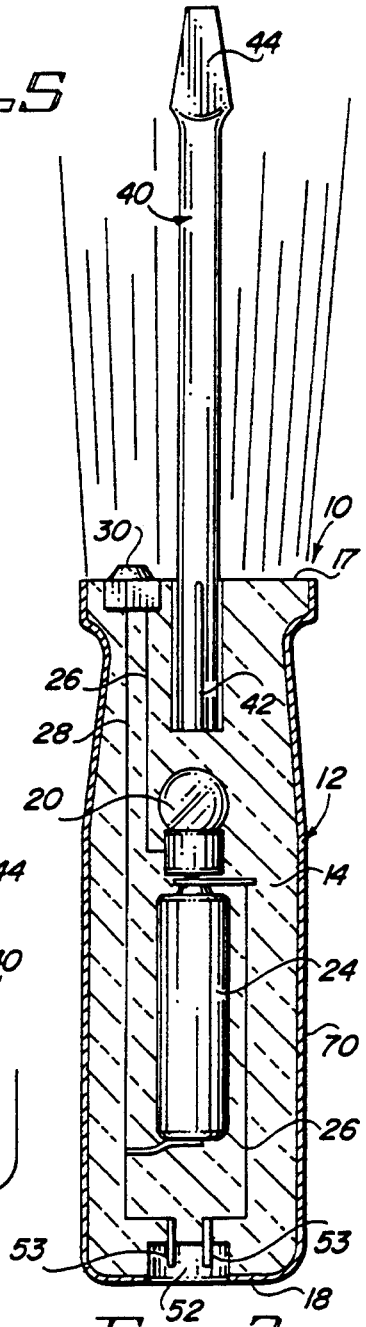
FIG. 3
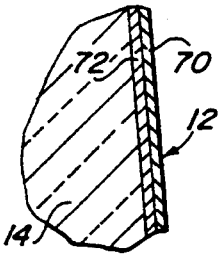
FIG. 2
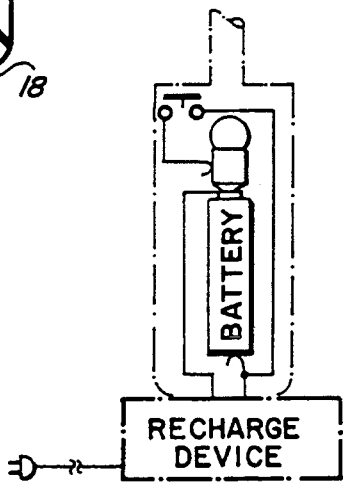
FIG. 4

LIGHT EMITTING SCREWDRIVER

BACKGROUND OF THE INVENTION

1. Field of the Invention

The present invention relates generally to illuminated tools, and more specifically to a screwdriver structured and disposed to direct light from within a handle thereof towards a distal tip of the screwdriver shaft.

2. Description of the Related Art

Various illuminated tools, such as screwdrivers, have long been available in the art. An example of such tools is shown in the U.S. Patents to Nalbandian et al, U.S. Pat. No. 4,283,757; Jong, U.S. Pat. No. 5,211,468; and U.S. Pat. No. 5,051,876. The tools disclosed in these patents are generally structured to provide light at an end of the tool, either at the handle or at the shaft.

In many of the illuminated tools in the related art, a light bulb is provided within the handle portion and is threadably secured within a terminal surrounded by a reflector element. In all cases, the bulb is surrounded by air, and in many devices the entire handle is hollow to also contain a battery, connector terminals and conductors between the terminals and a switch.

While the various illuminated tools in the related art may be useful for their intended purpose, all are susceptible to damage to the light bulb due to an external force, such as when dropping the tool. This is due to the fact that the light bulb, reflector shield and other elements are generally loosely held within the handle or on the shaft and are, accordingly, subject to movement caused by shock resulting from an externally applied force.

Accordingly, there still exists a need in the tool art for a light emitting tool, such as a screwdriver, which is highly durable and specifically designed to protect the light bulb and other contents within the handle from shock.

SUMMARY OF THE INVENTION

The present invention is directed to a tool, such as a screwdriver, including a solid core handle formed of a light conductive material. A light bulb is encased within the light conductive material of the handle and is electrically connected with a battery also encased within the solid core handle such that neither the light bulb nor battery are able to move relative to the solid core. A switch externally accessible on the handle opens and closes the circuit between the battery and light bulb to effectively energize and de-energize the bulb as desired.

A shaft includes a proximal end zone embedded within the solid core, extending outwardly from a first end of the handle and terminating at a free distal end in spaced relation from the handle. Upon activation of the light by closing the circuit between the battery and light bulb, light is directed through the light conductive material and out from the first end of the handle towards the distal end of the shaft.

In a first preferred embodiment the battery is entirely encapsulated within the handle and is not accessible for recharging. Accordingly, when the battery looses the charge, the bulb no longer illuminates, however, the the tool is still used the same as a conventional screwdriver. In another preferred embodiment, a recharging port is provided on a second end of the handle and is electrically connected with the battery. The recharging port is specifically structured for electrical connection with a conventionally available battery recharging device for supplying an electrical recharging current to the battery. Obviously, in this particular embodiment the battery would be of a rechargeable type.

With the foregoing in mind it is primary object of the present invention to provide a light emitting tool, such as a screwdriver, which is extremely durable yet inexpensive to manufacture.

It is another object of the present invention to provide a light emitting tool which is specifically designed to protectively encapsulate a light bulb, battery and electrical conductors within a solid core handle, thereby protecting the contents within the handle from damage due to shock.

It is a further object of the present invention to provide a light emitting tool having a solid core handle with a light bulb and rechargeable battery therein, the handle being provided with a recharging port for recharging the battery.

It is still a further object of the present invention to provide a light emitting tool having a shaft extending from a first end thereof and terminating at a distal end, wherein the tool is specifically designed to direct light through a solid light conducting medium from within the handle towards the distal end of the shaft.

These and other objects and advantages of the present invention will be more readily apparent in the description which follows.

BRIEF DESCRIPTION OF THE DRAWINGS

For a fuller understanding of the nature of the present invention, reference should be had to the following detailed description taken in connection with the accompanying drawings in which:

FIG. 1 is a side plan view, in partial section, illustrating a first preferred embodiment of the present invention;

FIG. 2 is an isolated sectional view of a handle of the tool of the present invention taken from the area indicated as 2 in FIG. 1;

FIG. 3 is a side plan view, in partial section, illustrating a second preferred embodiment of the present invention;

FIG. 4 is an electrical schematic of the tool illustrated in FIG. 3;

FIG. 5 is an isolated view, shown in perspective, illustrating a ball socket on a distal end of the screwdriver shaft for interconnection of various tool elements; and FIG. 6 is an isolated exploded view, shown in perspective, illustrating an alternative embodiment of the ball socket on the distal end of the screwdriver shaft.

Like reference numerals refer to like parts throughout the several views of the drawings.

DETAILED DESCRIPTION OF THE PREFERRED EMBODIMENT

Referring to the several views of the drawings, there is illustrated the present invention directed to a tool, and particularly a light emitting screwdriver, generally indicated as 10. The screwdriver of the present invention includes a solid core handle 12 at least partially formed of a light conductive material such as a transparent plastic or acrylic. In one preferred embodiment, the handle 12 includes an upper portion 14 and a lower portion 16. The upper portion 14 is formed of the light conductive material and the lower portion 16 is formed of a generally opaque, non-light conductive material. In another embodiment, the entire handle 12 is formed of the same light-conductive material 14. The handle includes a first end 17, an opposite second end 18 and a surrounding exterior side surface 19 defined about the exterior of the handle 12 between the first end 17 and opposite second end 18.

A light bulb 20 is encapsulated within the solid core light conductive material of the handle 12 and is positioned and disposed for directing light outwardly through the first end 17. A battery 24 is also encapsulated within the solid core of the handle 12 between the light bulb 20 and the second end 18 of the handle. The battery 24 is electrically connected with the light bulb by conductors including a positive lead 26 and a negative lead 28 defining an electrical circuit.

A switch 30 is provided on the exterior of the handle 12, preferably at the first end 17. The switch is operable between an on and off position to respectively open and close the circuit between the battery and light bulb so as to effectively energize and de-energize the bulb as desired.

A shaft 40 includes a proximal end zone 42 embedded within the solid core of the handle 12, extending outwardly from the first end 17 thereof, and terminating at a free distal end 44 in spaced relation from the end 17 of the handle 12. Accordingly, the shaft 40 remains fixedly attached to the handle 12. Upon. activation of the light bulb 20 by closing the circuit between the battery and the light bulb, light is directed through the light-conductive material out from the first end 17 of the handle towards the distal end 44 of the shaft 40.

The distal end 44 of the shaft 40 may be shaped and configured to define a screwdriver tip such as a flat head type tip or a Phillips head tip. Alternatively, the distal end 44 may be provided with a ball socket 50 specifically sized and configured for removable, attached receipt of commercially available screwdriver tips 51 or other tool elements therein.

In one preferred embodiment, the battery is entirely encapsulated within the handle and is not accessible for recharging. It is intended that this embodiment be a low cost product which is inexpensive to manufacture, but yet extremely durable for use in virtually any work environment. When the battery loses the charge, the bulb would no longer be illuminated, however, the screwdriver is still useful in the conventional manner. In another preferred embodiment, a recharging port 52 is provided on the second end of the handle 18 and including a male plug electrically connected with the positive and negative leads connecting with the battery. The recharging port 52 is specifically structured for electrical connection with a conventionally available battery recharging device for supplying an electrical recharging current to the battery.

In one embodiment of the invention, the interior core of the handle 12 may further be provided with fiber optic channels 60 or other enhanced light-conductive means. Specifically, one or several fiber optic channels 60 may be extended between the light bulb 20 and the first end 17 of the handle in order to provide a greater intensity of light focused towards the distal end 44 of the shaft 40. As seen in the drawings, a first end of the fiber optic strand is positioned adjacent the light bulb with an opposite end of the strand terminating at the end 17 of the handle. Similar to the installation of the light bulb, battery and conductors, the fiber optic strands are also be encapsulated within the solid core light-conductive material of the handle 12.

In order to prevent light from being emitted out from the sides and bottom end 18 of the handle 12, an opaque, non-light conductive paint 70 may be applied to the surrounding exterior side surface and bottom end 18 of the handle. In this manner, the only light emitted from the handle would be the light emitted from the first end 17 towards the distal end 44 of the shaft 40. To further intensify the light emitted from the first end 17, a first reflective layer of paint 72 may be applied to the side surface and bottom end 18 of the handle, prior to application of an exterior opaque coat 70, causing light to be reflected within the interior core and outwardly through the first end 17.

Now that the invention has been described,

What is claimed is:

1. A tool comprising:

a handle including a solid core interior, a first end, an opposite second end, and a surrounding side wall surface, and further including an upper portion adjacent said first end and a lower portion adjacent said second end, said upper portion being formed of a light conductive material structured and disposed to transmit light therefrom, a light emitting source encapsulated within said solid core interior of said handle and structured and disposed to direct light through said light conductive material and outwardly from said first end, a power source encapsulated within said solid core interior of said handle for supplying electrical power to energize said light emitting source, a shaft including a proximal end zone disposed and held within said upper portion of said handle, said shaft extending from said first end of said handle and terminating at a distal end in spaced relation to said handle, conductor means encapsulated within said handle electrically connecting said power source with said light source and defining a circuit, and switch means on said handle and externally accessible for operation thereof, said switch means being electrically connected to said conductor means and operable between an open circuit position to de-energize said light source and a closed circuit position, closing said circuit and supplying electrical power from said power source to said light source to energize said light source, causing light emitted therefrom to be transmitted through said light conductive material and out from said first end towards said distal end of said shaft.

2. A tool as recited in claim 1 wherein said light conductive material is a transparent plastic.

3. A tool as recited in claim 2 wherein said lower portion of said handle is formed of a non-light conductive material.

4. A tool as recited in claim 3 wherein said non-light conductive material of said lower portion is an opaque plastic.

5. A tool as recited in claim 1 wherein said distal end of said shaft is shaped and configured to define a screwdriver tip, being structured and disposed for driving engagement with a hardware fastening element.

6. A tool as recited in claim 1 wherein said distal end of said shaft includes a socket structured and disposed for removable attached receipt of a tool element therein.

7. A tool as recited in claim 6 wherein said tool element is a screwdriver tip.

8. A tool as recited in claim 1 wherein said power source includes a battery.

9. A tool as recited in claim 8 wherein said battery is rechargeable.

10. A tool as recited in claim 9 wherein said handle further includes a charging port electrically interconnected to said battery and structured for electrical engagement with a charging device for receipt of an electrical charging current.

11. A tool as recited in claim 1 wherein said side wall surface of said handle includes a coating of opaque paint applied thereto.

12. A tool as recited in claim 9 wherein said side wall surface further includes a first inner light reflective paint coating adapted to reflect light within said solid core interior causing the light to be emitted from said first end.

13. A tool as recited in claim 1 further including at least one fiber optic channel encapsulated within said solid core interior of said handle and including a first end disposed adjacent to said light emitting source at a second opposite end disposed adjacent said first end of said handle, said fiber optic channel being structured and disposed to direct a concentrated beam of light towards said distal end of said shaft.

14. A tool comprising:

a handle, including a solid core interior formed of a light conductive material and structured and disposed to transmit light therethrough, said handle further including a surrounding side wall surface, a first end and a second opposite end, a light emitting source encapsulated within said solid core interior of said handle and structured and disposed to direct light through said light conductive material and outwardly from said first end of said handle, a power source encapsulated within said solid core interior of said handle for supplying electrical power to energize said light emitting source, a shaft including a proximal end zone disposed and held in said handle, said shaft extending from said first end of said handle and terminating at a distal end in spaced relation to said handle, conductor means encapsulated within said handle and electrically connecting said power source with said light source and defining a circuit, and switch means on said handle and externally accessible for operation thereof, said switch means being electrically connected to said conductor means and operable between an open circuit position to de-energize said light source and a closed circuit position, closing said circuit and supplying electrical power from said power source to said light source to energize said light source, causing light emitted therefrom to be transmitted through said light conductive material and out from said first end towards said distal end of said shaft.

* * * * *